United States Patent [19]

Graham, Jr. et al.

[11] Patent Number: 4,709,235

[45] Date of Patent: Nov. 24, 1987

[54] LOW-DRAG, RAM-AIR INFLATED, MILLIMETER WAVE, PASSIVE RADAR DECOY

[75] Inventors: John J. Graham, Jr.; Joseph C. Huber, Jr., both of Cuyahoga Falls; John E. Neumann, Uniontown, all of Ohio

[73] Assignee: Loral Corporation, New York, N.Y.

[21] Appl. No.: 930,627

[22] Filed: Nov. 14, 1986

[51] Int. Cl.[4] ..... H01Q 15/00

[52] U.S. Cl. ..... 342/10

[58] Field of Search ..... 342/8, 9, 10, 12, 13

[56] References Cited

U.S. PATENT DOCUMENTS

| | | | |
|---|---|---|---|
| 2,731,046 | 1/1956 | Bachner | 342/9 X |
| 3,122,743 | 2/1964 | Vlasic | 342/10 |
| 3,160,879 | 12/1964 | Downing et al. | 342/10 X |
| 3,530,469 | 9/1970 | Dailey et al. | 342/10 |
| 3,568,191 | 3/1971 | Hiester et al. | 342/8 |
| 4,540,987 | 9/1985 | Werkes et al. | 342/10 |

*Primary Examiner*—T. H. Tubbesing
*Assistant Examiner*—John B. Sotomayor
*Attorney, Agent, or Firm*—P. E. Milliken; L. A. Germain

[57] ABSTRACT

An aircraft-launched, ram-air inflatable, passive radar decoy (10) has a substantially cylindrically shaped body (12) having an open forward end (14) and a closed porous rearward end (16), the body comprised of a fabric reinforced composite having a high radar reflectivity coating on at least it interior surfaces (**12*i*, 16*i*). A rod-shaped weight (22) is attached at the forward end (14) by way of shroud lines (20), the weight (22) providing the highest weight-to-drag-area ratio for the particular size body. The decoy (10**) provides a high radar cross section and broad angle coverage to ground-based source of radar when it is ram-air inflated upon ejection by the aircraft into its adjacent windstream.

9 Claims, 2 Drawing Figures

LOW-DRAG, RAM-AIR INFLATED, MILLIMETER WAVE, PASSIVE RADAR DECOY

BACKGROUND OF THE INVENTION

This invention generally relates to aircraft radar countermeasures and more particularly to an aircraft-launched, self-inflated, low drag aerodynamic decoy which provides a large radar reflection and doppler frequency return at millimeter wave frequencies to defeat ground-based enemy radar and radar-guided weapons.

The use of chaff to defeat the radar function by denying it range and direction (azimuth and elevation) information is a well-known and practiced technique in the art of radar jamming. Conventionally, passive chaff elements in the form of discrete dipoles are dispensed by an aircraft to form a cloud which creates a credible false target to ground-based radar. The dipoles are comprised of low mass slivers of metallized mylar, glass or other suitable dielectric material and these are ejected by the aircraft into its adjacent windstream where vehicle-induced turbulence or wind shear effects are available for dispersion and cloud formation.

One of the problems with chaff of the type described is that current practices are limited to frequencies below 20 GHZ and furthermore, upon ejection, they rapidly slow down and fall at an almost constant rate due to their very low mass. Accordingly, the useful life of the chaff is very short for lack of a doppler frequency return to the enemy radar. The radar can therefore update its return information and easily determine the location of the aircraft because of its doppler frequency signature.

A primary purpose of this invention is to provide a radar decoy which matches the doppler spectra so that doppler-sensitive threat systems cannot detect a difference between the decoy and the aircraft being protected. Further, the decoy provides an extended operational life for greater aircraft protection.

SUMMARY OF THE INVENTION

An aircraft-launched passive radar decoy provides an increased radar reflection and doppler frequency return to a ground-based radar and comprises in combination:

a substantially cylindrically-shaped, lightweight, ram-air inflatable, leno-woven fabric reinforced composite body having an open forward end and a substantially hemispherically shaped closed rearward end, the forward end adapted to receive ram-air for inflation of the body;

a small-diameter, rod-shaped weight positioned ahead of the forward end of the body;

a plurality of shroud lines affixed to the body and to the weight to provide a spaced-apart interconnection between the two; and a radar reflective coating on at least the inside surfaces of the composite forming the cylindrically-shaped and hemispherically-shaped portions of the body to provide a high radar cross-section and broad-angle coverage to ground-based radar when the body is inflated upon ejection by an aircraft into its adjacent windstream.

BRIEF DESCRIPTION OF THE DRAWINGS

The invention may best be understood by reference to the following detailed description when taken in conjunction with the accompanying drawings in the several figures in which like-reference numerals indicate like elements and in which.

DETAILED DESCRIPTION OF THE INVENTION

Figure 1:
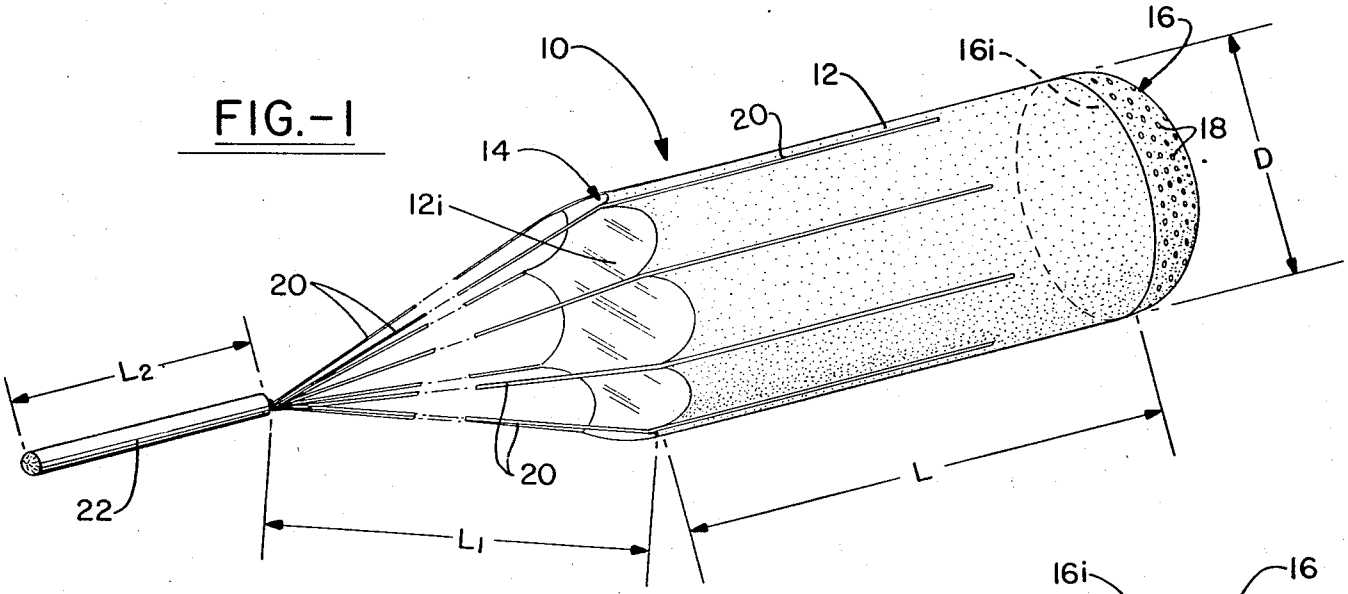
FIG. 1 is a perspective view of a low-drag, ram-air inflated, aerodynamically-stable, passive radar decoy in accordance with this invention.

Referring to the drawings, a passive radar decoy in accordance with this invention is generally indicated by reference numeral 10. The decoy 10 comprises a substantially cylindrically-shaped body 12 characterized by an open forward end 14 and a substantially closed rearward end 16. In its inflated condition the decoy 10 is substantially cylindrical throughout its length indicated by "L", however and because it is ram-air inflated, the rearward end 16 takes a substantially hemispherical shape. The decoy 10 comprises a composite material which includes any lightweight fabric exhibiting a tensile strength sufficient to withstand the vigorous forces experienced when the decoy is ram-air inflated within the adjacent windstream of a tactical aircraft travelling at speeds to Mach 1. A suitable composite material should also exhibit an ability to being folded and/or compressed without loosing its physical properties during such packaged storage. A reason for this is that such decoys may be stored onboard an aircraft in a countermeasures cartridge for long periods of time before being deployed. In any event, the composite material preferably comprises a leno-woven scrim fabric embedded in mylar, the fabric exhibiting a weight within the range of 0.25–1.25 oz/yd$^2$ (8.5–42.4 gms/m$^2$). A dacron, nylon, glass, aramid or similar type scrim fabric will meet the needs of the invention when embedded in mylar having a thickness within the range of 0.2–0.5 mils. A particular one such composite comprises a leno-woven dacron scrim fabric having a weight within the range of 0.6–0.9 oz/yd$^2$ (20.3–30.5 gms/m$^2$) and embedded in mylar having a thickness within the range of 0.2–0.5 mils.

An aluminized or silver-loaded coating is painted or otherwise deposited on at least one face surface of the composite material to provide a continuous electrically conductive surface for high radar reflectivity. Various coatings which will work in this type application are known to persons knowledgeable and skilled in the countermeasures arts and, while both the interior and exterior surface areas of the decoy body 12 may be coated with the conductive coating, the interior surfaces indicated at **12*i* and 16*i*** are preferably coated.

Figure 2:
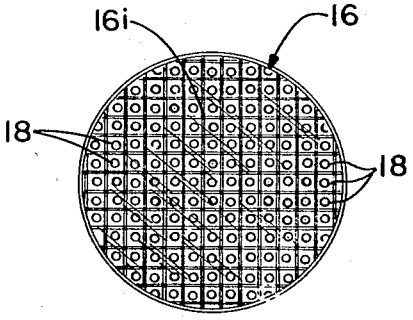
FIG. 2 is a plan view of the material comprising the rearward end of the decoy.

Further, it is important that the transition area as between the cylindrically-shaped portion 12 and the hemispherically-shaped portion 16 be such as to provide continuous conductivity as between the two portions. This may be accomplished in various ways depending upon the manner of fabrication and it is considered well within the knowledge and skill of persons working in the art of fabricating parachutes, Ballutes (TM Goodyear Aerospace Corp., Akron, Ohio) and similar type devices to provide such continuous conductivity within the decoy. The rearward end closure 16 is preferably porous to allow for through passage of the ram air necessary for inflation while also providing the low drag necessary for a doppler frequency radar return. Accordingly, the rearward portion 16 is characterized by a plurality of holes 18 which are punched, stamped out, or otherwise provided through the material comprising the end closure 16. The size and spacing of the holes 18 must be such as to allow for sufficient air passage for low-drag operation while maintaining a high radar reflectivity over the coated area. Further, the strength of the rearward closure 16 must not be compromised by the holes because the decoy body must maintain its shape during the critical period of its operation. This is accomplished by positioning the holes 18 within the areas between the leno-woven fibers of the fabric as illustrated in FIG. 2 of the drawings. Thus, hole location may be controlled in the manufacture of the scrim fabric material, and this by the density of the fabric weave.

The forward open end 14 of the decoy body 12 carries a plurality of shroud lines 20 which are connected at their opposite ends to a weight 22. So as to provide optimum trajectory, ie., aerodynamics, to the decoy in flight the length L1 of the shroud lines between the decoy body 12 and weight 22 should be approximately twice the diameter "D" of the decoy. This specification may be verified by tests for different sized decoys. At any rate, the shroud lines 20 have a preferably flat cross section and extend longitudinally along the length of the decoy body 12 for a portion of the length "L". The longitudinal extent of the lines along the body may be about 75% of the length "L" and this to provide sufficient contact area as the lines may be adhesively secured to the body 12 and also to provide added strength when the decoy is ram-air inflated. Any suitable adhesive may be used which maintains the shroud lines 20 in their proper orientation on the decoy body during the short period of its operation.

The weight 22 is preferably a small diameter, rod-shaped weight comprising a dense metal mass, such as for example Kennertium (TM Kennametal, Inc., Latrobe, Pa.). Its purpose is to provide stability and a high weight-to-drag-area ratio to the decoy. In this respect, the small diameter rod-shaped configuration will not adversely interfere with radar impinging on the decoy from a ground-based source. Further, the length L2 of the rod-shaped weight 22 may be easily varied for weight optimization to achieve a desired weight-to-drag-area ratio and it may also be advantageous in packaging of the decoy within a cartridge as conventionally used for chaff deployment. In such cartridges, an explosive squib at the inboard end exerts pressure on a piston-like piece which operates to force the chaff, decoy, etc. out of the opposite outboard end of the cartridge which is normally closed by a cover piece. Accordingly, the rod-shaped weight 22 may be packaged longitudinally within the cartridge case and the piston force on it effects removal of the cover piece almost instantaneously.

Finally, it will be appreciated by those persons skilled in this art that the decoy of this invention may be optimized for maximum radar return in the millimeter wave frequency ranges of interest. For example, it may be shown that for a millimeter frequency range of about 35 GHZ the decoy length "L" should be about 30 inches (76.2 cm) and the diameter "D" should be about 7.5 inches (19 cm). A decoy of this size and comprised of the materials described may be easily packaged within the available space of a conventional aircraft countermeasures cartridge. It will be further appreciated that the decoy may also be configured in a size to provide maximum radar return at a frequency of about 95 GHZ. In fact, the inventive concept may be applied to any millimeter wave frequency and this will, of course, depend upon the threat that is required to be decoyed away from the subject aircraft.

While certain specific elements and details have been shown for the purpose of illustrating the invention, it will be apparent to those skilled in this art that various changes and modifications may be made therein without departing from the spirit or scope of the invention.

What is claimed is:

1. An aircraft-launched countermeasures passive radar decoy providing an increased radar reflection and doppler frequency return to a ground-based radar upon being ejected by the aircraft, comprises in combination:

a substantially cylindrically-shaped, lightweight, ram-air inflatable, fabric-reinforced composite body having an open forward end and a substantially hemispherically-shaped closed rearward end, the forward end adapted for receiving ram-air to inflate the body and said fabric reinforcement comprising a leno-woven scrim fabric exhibiting a weight within the range of 0.25–1.25 oz/yd$^2$ (8.5–42.4 gms/m$^2$);

a small-diameter, rod-shaped weight positioned ahead of the forward end of the body and exhibiting the highest weight-to-drag-area ratio required for the most effective aerodynamic effect when the composite body is inflated and in a free-fall flight;

a plurality of shroud lines affixed to the body and the weight to provide a spaced-apart interconnection between the two; and a radar-reflective coating on at least all inside surfaces of the body to provide a high radar cross-section and broad-angle coverage to a ground-based radar when the body is inflated upon ejection by the aircraft.

2. The decoy as set forth in claim 1 wherein the hemispherically-shaped rearward end is characterized by a plurality of holes through the composite to exhaust ram-air from the body, the number and spacing of the holes being such as to provide the lowest drag operation while maintaining the highest reflectivity for radar impinging on the body.

3. The decoy as set forth in claim 2 wherein the holes through the composite are in the areas between the leno-woven fibers of the fabric, the number and spacing being determined by the density of the woven fabric.

4. The decoy as set forth in claim 3 wherein the leno-woven scrim fabric comprises fibers selected from the group comprising dacron, nylon, glass, and aramid.

5. The decoy as set forth in claim 4 wherein the leno-woven scrim fabric is embedded in mylar having a thickness within the range of 0.2–0.5 mils.

6. The decoy as set forth in claim 4 wherein the leno-woven scrim fabric comprises dacron having a weight within the range of 0.6–0.9 oz/yd$^2$ (20.3–30.5 gms/m$^2$).

7. The decoy as set forth in claim 2 wherein the length "L" and diameter "D" of the body are optimized for radar frequencies of about 35 GHZ.

8. The decoy as set forth in claim 7 wherein the length "L" is approximately 30 inches (76.2 cm) and the diameter "D" is approximately 7.5 inches (19 cm).

9. The decoy as set forth in claim 2 wherein the length "L" and diameter "D" are optimized for radar frequencies of about 95 GHZ.

* * * * *